United States Patent [19]

Corbus et al.

[11] 4,361,480

[45] Nov. 30, 1982

[54] SEPARATOR UNIT FOR GOLD MINING ASSEMBLY

[76] Inventors: Henry F. Corbus; Richard F. Corbus, both of 220 Oak, North Miami, Okla. 74358

[21] Appl. No.: 288,149

[22] Filed: Jul. 29, 1981

[51] Int. Cl.[3] ..... B03B 5/58; B04B 1/10

[52] U.S. Cl. ..... 209/453; 233/10; 233/27

[58] Field of Search ..... 209/445, 453, 505; 233/10, 27

[56] References Cited

U.S. PATENT DOCUMENTS

| | | | |
|---|---|---|---|
| 126,968 | 5/1872 | Keller | 299/9 |
| 489,101 | 1/1893 | Seymour | 209/199 |
| 954,580 | 4/1910 | Palmer | 209/466 |
| 980,001 | 12/1910 | Ponten | 233/27 X |
| 1,042,194 | 10/1912 | Bradbury | 209/453 X |
| 1,105,294 | 7/1914 | Newell et al. | 209/280 |
| 1,461,067 | 7/1923 | Moser | 209/234 |
| 1,853,249 | 4/1932 | Ainlay | 209/453 X |
| 2,112,099 | 3/1938 | Ballou et al. | 233/10 |
| 2,133,271 | 10/1938 | Brintnall | 209/12 |
| 2,272,675 | 2/1942 | Knudsen | 233/27 |
| 2,858,064 | 10/1958 | Clow et al. | 209/453 X |
| 3,232,426 | 2/1966 | Caparella et al. | 209/44 |
| 3,941,690 | 3/1976 | Powers et al. | 209/443 |

*Primary Examiner*—Ralph J. Hill

*Attorney, Agent, or Firm*—Schmidt, Johnson, Hovey & Williams

[57] ABSTRACT

An improved rotatable separator unit for gold or other ore separation is provided which gives enhanced ore recovery and can be installed on a mobile frame for transport to a mine site. The separator includes an upright, preferably frustoconical, ore-receiving bowl equipped with a plurality of generally horizontal vertically spaced apart ribs secured to the inner face of the bowl and extending inwardly therefrom in a "stair step" fashion; a central stationary conduit pipe is also provided for introduction of material into the bowl, along with powered means for rotation of the bowl about an upright axis. In particularly preferred forms, the separator is provided with a plurality of circumferentially spaced, stationary, obliquely oriented baffles located within the bowl and adjacent the inner edges of the bowl ribs for creating turbulence at the regions of the ribs and facilitating separation of the ore from undesired debris such as relatively large rocks.

1 Claim, 6 Drawing Figures

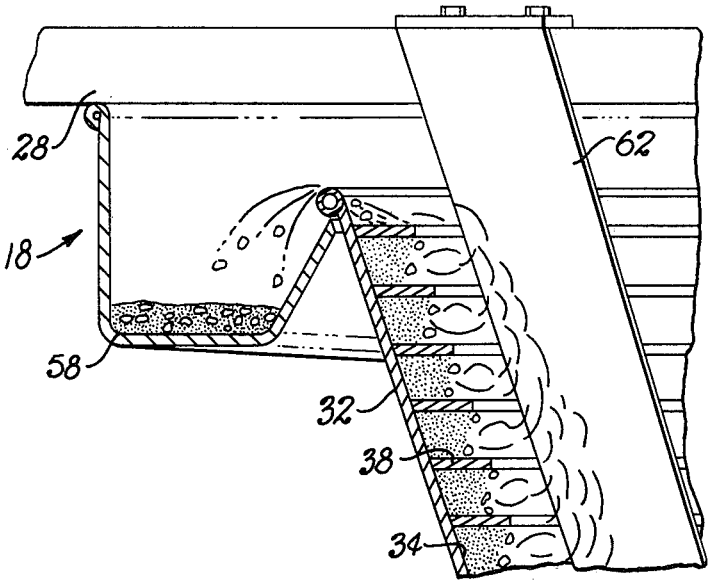
Fig. 6
Fig. 4
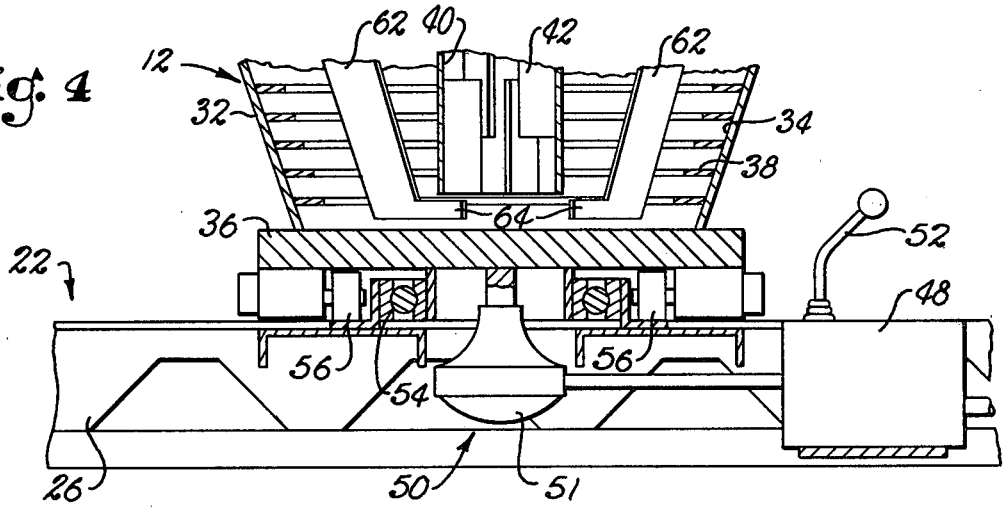
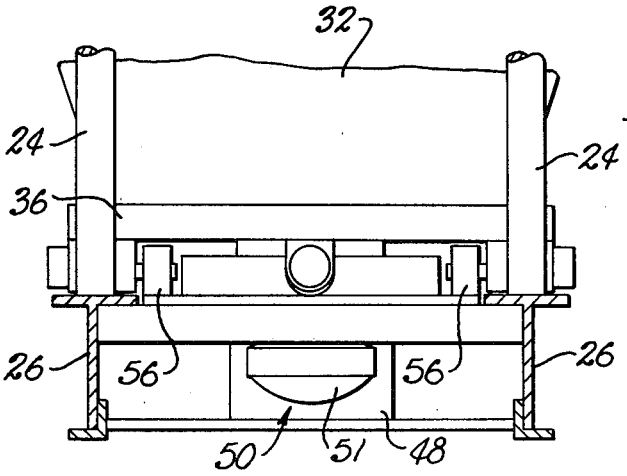
Fig. 5

SEPARATOR UNIT FOR GOLD MINING ASSEMBLY

BACKGROUND OF THE INVENTION

1. Field of the Invention

The present invention is concerned with a centrifugal ore separation device particularly designed for use in separating gold and so-called "black sand" from mine output. More particularly, it is concerned with such a separator which is advantageously used in conjunction with other separation equipment on a flatbed trailer or the like which can be easily moved to a mine site.

2. Description of the Prior Art

Man has mined the earth to extract its riches for thousands of years. Although various ores have been sought at different times through the ages, gold has remained as one of the most sought after treasures, and accordingly considerable effort has been expended in developing various techniques and devices to facilitate gold mining and refining.

In certain regions gold is found in conjunction with so-called "black sand" which is a heavy, dark, particulate sand-like collection of minerals, usually magnetite and ilmenite. Other minerals may also be present with the gold and black sand, e.g., platinum and monazite. Black sand is in and of itself a salable commodity, its principal use being in the manufacture of coarse grit sandpaper. Accordingly, in the mining of gold where black sand is also found, it is a common practice to recover both the gold and black sand.

It also frequently occurs that mine sites are located in relatively remote areas, or the amount of ore at a given site may be relatively small. In such cases the expense involved in permanent, on-site construction of refining equipment may be greater than the expected return from mining. Thus, there is a real need for an effective, portable unit for gold or other ore refining.

Of course, the ultimate goal of any mining operation is to maximize the extent of ore and salable by-product recovery with minimum expense and effort. Efficiency of recovery is therefore of prime importance, and a number of prior patents have described various separation devices developed in an attempt to enhance profitable recovery from mining operations. Such U.S. Pat. Nos. include 2,133,271, 3,941,690, 489,101, 126,968, 954,580, 1,042,194, 1,105,294, 1,461,067 and 3,232,426.

SUMMARY OF THE INVENTION

The present invention is broadly concerned with an improved separator unit for recovering gold and black sand or other valuable products, and includes an upright bowl presenting a sloped inner face, along with a plurality of generally horizontal, vertically spaced apart flights or ribs secured to the inner face of the bowl and extending inwardly therefrom. The separator further includes means such as a central upright delivery pipe for introducing ore or other material to be separated into the bowl, and powered means for rotating the bowl about an upright axis for centrifugal separation.

In particularly preferred forms, the bowl is of generally frustoconical configuration, with the respective ribs being substantially circular in plan and extending continuously about the inner bowl face. Advantageously, the ribs are arranged such that the inner margin of each rib is located inward relative to the inner margin of the next higher rib. In this fashion, the ribs are arranged in a "stair step" orientation which is important for purposes to be described.

The preferred separator unit also includes a plurality of obliquely oriented, upright, stationary baffles which are located in circumferentially spaced relationship adjacent the bowl ribs. As the bowl rotates, the stationary baffles create turbulence at the region of the ribs, so as to facilitate separation of large rocks and other debris from the gold and black sand. Such debris is then transferred upwardly and is ultimately collected within an annular, trough-like collector positioned about the upper periphery of the bowl.

BRIEF DESCRIPTION OF THE DRAWINGS

FIG. 4 is an enlarged, fragmentary vertical sectional view illustrating the base of the separator unit and the connection thereof to a flatbed trailer;

FIG. 5 is a fragmentary end view of the base of the separator unit; and

FIG. 6 is a fragmentary, enlarged vertical sectional view illustrating the separation action of the separator unit hereof, and particularly the turbulence created by virtue of the upright, stationary baffles within the separator bowl.

DESCRIPTION OF THE PREFERRED EMBODIMENT

Figure 1:
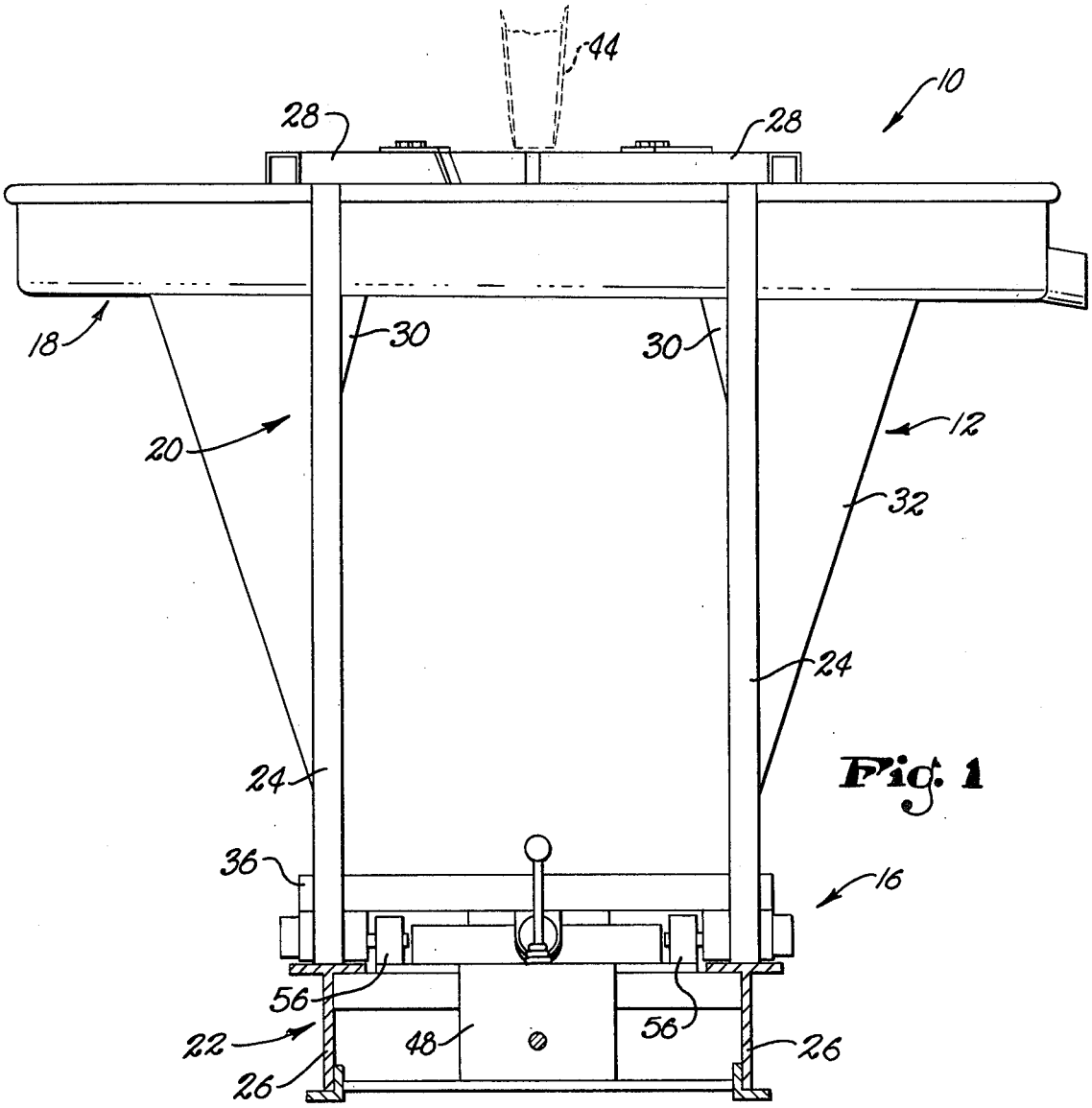
FIG. 1 is an end view illustrating the preferred separator unit in accordance with the invention, with a delivery spout to the separator being depicted in phantom.

Turning now to the drawings, a separator unit 10 in accordance with the invention broadly includes an upright, open top, ore-receiving bowl 12, means generally referred to by the numeral 14 for introducing material to be separated into bowl 12, structure 16 for selective rotation of bowl 12 about an upright axis, trough-like means 18 for receiving products of separation from the bowl, and a frame assembly 20 supporting the foregoing components.

The separator unit 10 is particularly adapted for mounting onto a flatbed trailer 22 of conventional construction. In addition, the separator 10 is designed to be used in conjunction with other ore handling cmponents which are likewise mounted on the trailer 22. For example such other equipment may include a vibrating "grizzly" screen, a secondary screen and a roll screen, along with conveyors and like equipment for handling the ore products. All of these devices are conventional and well known to those skilled in the art, and therefore require no detailed discussion. However, it should be understood that the separator 10 hereof is generally the last handling component on the trailer, and the final black sand and gold product is recovered from the separator 10. This black sand and gold is then further separated using additional equipment not relevant to the instant invention.

In more detail, the frame assembly 20 includes four upright, spaced apart main struts 24 which are fixedly secured to underlying beams 26 forming a part of trailer 22. In addition, the assembly 20 includes four converging, inwardly extending elongated supports 28 which are respectively secured to the upper end of a corresponding strut 24. Each strut 24 further includes a gusset 30 which engages and supports the collector 18 (see FIG. 3).

The bowl 10 preferably includes an upright, open top, substantially rectilinear sidewall 32 presenting a rectilinear, sloped inner face 34, along with a circular, flat bottom wall 36. It will thus be seen that the bowl 12 is of generally frustoconical configuration.

Figure 2:
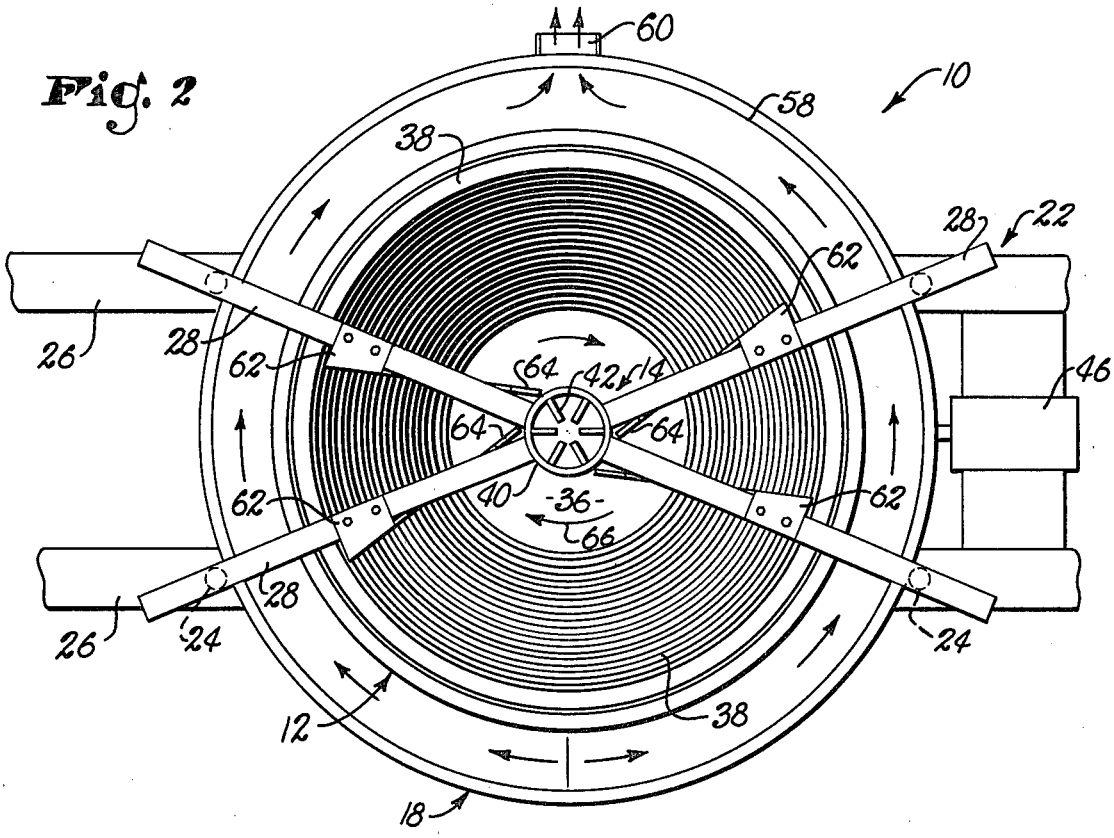
FIG. 2 is a plan view of the separator illustrated in FIG. 1.
Figure 3:
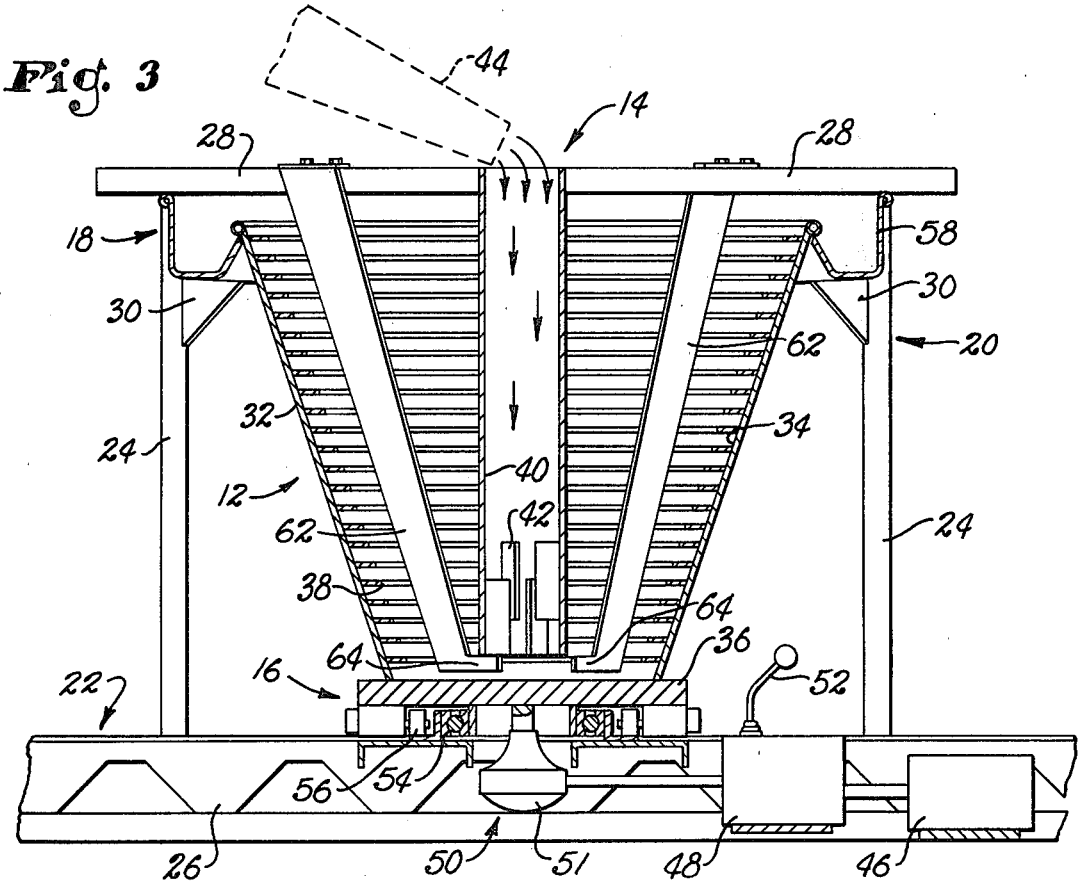
FIG. 3 is a vertical sectional view of the separator of FIGS. 1–2.

The bowl is further provided with a plurality of generally horizontal, vertically spaced apart ribs 38 which are secured to inner face 34 and extend inwardly therefrom. Referring specifically to FIGS. 3 and 6, it will be observed that the ribs 38 are arranged in a "stair step" fashion in that the inner terminus of each rib is inboard of the inner terminii of the ribs thereabove. It will also be seen (FIG. 2) that the ribs 38 are substantially circular in plan and are continuous about inner face 34.

Material introduction means 14 is in the form of a stationary, upright delivery pipe 40 which is secured to the innermost ends of the supports 28. The lower end of pipe 40 is spaced above bottom wall 36, and is further provided with a series of circumferentially spaced, vertically offset, internal elongated baffles 42. In the preferred use of separator 10, a delivery spout 44 is situated above the open upper end of pipe 40 for delivery of an ore-water slurry to bowl 12 through pipe 40.

The structure 16 includes a motor 46 coupled to a transmission 48 and a drive assembly 50 (the latter having a differential 51) which is in turn operatively connected to bottom wall 36 of bowl 12. It will be appreciated in this regard that the motor 46, transmission 48 and assembly 50 are designed for relatively high speed rotation of bowl 12 about an upright axis. A shift lever 52 is provided with transmission 48 in order that appropriate start up and running gears can be employed.

The bowl 12 is supported for rotation by means of an inner, circular ball bearing assembly 54, and a plurality of circularly arranged outer rotatable rollers 56. Of course, those skilled in the art will recognize that any one of a number of different mounting devices can be employed for rotatably supporting the bowl 12.

The collection means 18 is preferably in the form of an annular, trough-like basin 58 which is generally U-shaped in cross section and is fixedly supported by means of the gussets 30. An outlet channel 60 is also secured to the basin 58 and communicates with the interior thereof.

The separator unit 10 also includes a plurality (e.g., four) stationary, elongated, inclined baffles 62. Each baffle 62 is fixed to a corresponding support 28 and extends downwardly in an oblique fashion into bowl 12. The lowermost end of each baffle 62 is spaced slightly above bottom wall 36 and includes a projecting foot 64 which is obliquely oriented relative to the delivery pipe 40 (see FIG. 2). It will also be observed that the feet 64 are oriented in the same general direction as the direction of rotation of bowl 12 (illustrated by arrows 66 in FIG. 2).

In the use of separator 10, a slurry comprising water, gold or other ore to be recovered and black sand is delivered to the upper end of pipe 40 via spout 44. The slurry then passes through the pipe and exits the same adjacent bottom wall 36. Mixing of the slurry is facilitated during delivery thereof by virtue of the presence of the baffles 42 within pipe 40. As the slurry enters the bowl 12, it is initially directed in a circular pattern because of the rotation of the bowl, and also because of the position of the stationary feet 64.

As the slurry migrates radially outwardly under the influence of centrifugal force created because of rotation of the bowl 12, the slurry encounters the vertically spaced apart ribs 38. As rotation proceeds, gold and black sand tend to collect atop the respective ribs 38, and are maintained in position because of centrifugal force. However, rocks and other undesirable debris are moved upwardly during rotation of the bowl 12, principally by virtue of the turbulence created adjacent the inner edges of the ribs 38 because of the presence of the stationary baffles 62. This action is illustrated in FIG. 6, where it will be seen that the turbulence-creating baffles 62 tend to lift and elevate the unwanted debris on a stepwise basis, until such material passes over the upper rim of the bowl and is collected within the basin 58. When all or a significant portion of the ribs 38 are filled with gold and black sand (determined when these materials begin collecting in basin 58), bowl 12 is stopped and the desired material is collected from the bowl. At this point, or even during operation of the bowl, the basin 58 can be flushed of unwanted debris.

Practice with a separation device of the type herein described has demonstrated that collection efficiencies are greater than those experienced with conventional separation units. This is believed to be chiefly attributable to the use of the preferred bowl 12 equipped with the inwardly extending ribs 38.

We claim:

1. A separator unit comprising:

an upright, generally frusto-conical bowl presenting a sloped inner face, an open top and a bottom wall;

a delivery pipe for introducing material to be separated into said bowl;

means for rotating said bowl about an upright axis;

a plurality of generally horizontal, vertically spaced-apart ribs secured to said inner face and extending inwardly therefrom; and a plurality of stationary, elongated, L-shaped baffles, each having a major leg and a minor leg, the major leg of each baffle extending from the open top of the bowl to a point adjacent said bottom wall and being substantially parallel with said sloped inner face of the bowl, the minor leg of each baffle extending laterally from the major leg and being spaced slightly above said bottom wall, in substantially parallel relationship thereto and defining a projecting foot which is obliquely oriented with respect to said delivery pipe, said feet being oriented in the same general direction as the rotation of the bowl.

* * * * *